US005785813A

United States Patent [19]

Smith et al.

[11] Patent Number: 5,785,813

[45] Date of Patent: Jul. 28, 1998

[54] METHOD OF TREATING A PAPERMAKING FURNISH FOR MAKING SOFT TISSUE

[75] Inventors: Michael John Smith, Neenah; Vinay Kumar Rao, Menasha; Gary Lee Shanklin, Appleton, all of Wis.

[73] Assignee: Kimberly-Clark Worldwide Inc., Neenah, Wis.

[21] Appl. No.: 805,089

[22] Filed: Feb. 24, 1997

[51] Int. Cl.[6] ..... D21H 23/14

[52] U.S. Cl. ..... 162/158; 162/111; 162/164.1; 162/164.3; 162/164.4; 162/164.6; 162/166; 162/168.1; 162/168.2; 162/168.3; 162/169; 162/175; 162/178; 162/183

[58] Field of Search ..... 162/111, 112, 162/113, 109, 158, 164.1, 168.1, 169, 175, 183, 182, 164.3, 164.6, 165, 166, 168.3, 168.2, 178

[56] References Cited

U.S. PATENT DOCUMENTS

| | | | |
|---|---|---|---|
| 3,151,017 | 9/1964 | Brafford | 162/183 |
| 3,755,220 | 8/1973 | Freimark et al. | 260/17.3 |
| 3,844,880 | 10/1974 | Meisel et al. | 162/183 |
| 3,998,690 | 12/1976 | Lyness et al. | 162/183 |
| 4,144,122 | 3/1979 | Emanuelsson et al. | 162/158 |
| 4,351,699 | 9/1982 | Osborn, III | 162/112 |
| 4,447,294 | 5/1984 | Osborn, III | 162/158 |
| 4,795,530 | 1/1989 | Soerens et al. | 162/111 |
| 4,940,513 | 7/1990 | Spendel | 162/112 |
| 4,959,125 | 9/1990 | Spendel | 162/158 |
| 5,217,576 | 6/1993 | Van Phan | 162/158 |
| 5,262,007 | 11/1993 | Phan et al. | 162/158 |
| 5,279,767 | 1/1994 | Phan et al. | 252/357 |
| 5,348,620 | 9/1994 | Hermans et al. | 162/9 |
| 5,354,425 | 10/1994 | Mackey et al. | 162/135 |
| 5,397,435 | 3/1995 | Ostendorf et al. | 162/112 |
| 5,405,501 | 4/1995 | Phan et al. | 162/127 |
| 5,437,766 | 8/1995 | Phan et al. | 162/112 |
| 5,529,665 | 6/1996 | Kaun | 162/112 |

OTHER PUBLICATIONS

Swerin, Agne, Lars Odberg, and Ulf Sjodin, "Flocculation—Microparticle Retention Aid Systems," *Paper Technology*, vol. 33, No. 12, Dec. 1992, pp. 28–29.

*Primary Examiner*—Peter Chin
*Attorney, Agent, or Firm*—Gregory E. Croft

[57] ABSTRACT

An efficient and effective method for treating tissue making stock to make soft tissues involves adding a softening agent to a first papermaking furnish of short fibers, such as eucalyptus fibers. A second papermaking furnish of long fibers, such as softwood fibers, is blended with the short fiber furnish. Thereafter, wet strength agents and/or dry strength agents are added to the blended furnish. The treated furnish is then fed to a headbox and processed into soft tissue in any suitable manner.

9 Claims, 2 Drawing Sheets

METHOD OF TREATING A PAPERMAKING FURNISH FOR MAKING SOFT TISSUE

BACKGROUND OF THE INVENTION

The use of softening and strengthening agents in the manufacture of tissues, such as facial and bath tissue, is common practice in the industry. These tissues typically contain a blend of relatively long fibers, which are usually softwood fibers, and relatively short fibers, which are usually hardwood fibers. The softening and strengthening agents may be separately added to these different fiber species prior to blending the fibers together and forming the tissue web. The softening agent is added to the short fibers since the short fibers primarily contribute to tissue softness. The long fibers are separately treated with strengthening agents (wet and dry) and refining. Both refining and strengthening agents are used because excessive use of either treatment may have an adverse effect on the tissue making process and/or the resulting tissue product.

However, the conventional method of adding strengthening agents to the long fibers can have some disadvantages. In one case, combining strengthening agents with refining in the same locale can cause poor efficiency. If strengthening agents are added prior to refining, shear forces may strip the attached strengthening agent from the fiber. If strengthening agents are added directly after refining, the strengthening agents preferentially attach to fines generated by refining, thus reducing the chemical efficiency.

In addition, adding the strengthening agents to the long fiber in the conventional manner results in a long dwell time for the strengthening agent to reach the headbox. Very often changes in rates of addition are needed to maintain basesheet specifications. By adding the strengthening agents too far back in the system, there exists a greater probability of the product being outside targeted specifications for a longer period of time, resulting in higher waste and delay on the tissue machine.

Therefore there is a need for a more efficient method of utilizing softening agents and strengthening agents in the manufacture of tissues.

SUMMARY OF THE INVENTION

It has now been discovered that an especially soft tissue can be produced by the selective and sequential addition of chemical softening and strengthening agents to tissue. More specifically, one or more softening agents are added to the short fiber furnish prior to blending the short fibers with the long fibers. Once blended, the entire furnish is treated with dry strength and wet strength additives, formed, dewatered, and dried to produce a tissue product with adequate strength, absorbency, and superior softness. Refining of the long fiber can be minimized to maximize bulk development. The process, involving relatively low capital costs, is easily incorporated into conventional wet-pressed and through-dried assets to make single-ply or multi-ply tissue products.

Hence in one aspect, the invention resides in a method of treating a papermaking furnish comprising: (a) adding a softening agent to a first papermaking furnish comprising primarily short papermaking fibers; (b) blending the first papermaking furnish with a second papermaking furnish comprising primarily long papermaking fibers; and (c) adding one or more dry strength agents and/or one or more wet strength agents to the blended furnish.

The dry strength agent(s) and the wet strength agent(s) can be added in any order, although first adding the strengthening agent having the lower charge density is preferred to enhance its substantivity to the fibers. Charge density correlates with the ability of the strengthening agent to adhere to the fibers. The determination of charge density is referred to in "Microparticle Retention-Aid Systems" by A. Swerin et al., Paper Technology, Vol. 33, No. 12, pp. 28–29, December 1992, which is hereby incorporated by reference.

As used herein, "short" papermaking fibers are papermaking fibers having an average length of about 1 millimeter or less. Short papermaking fibers include most of the hardwood species such as eucalyptus, maple, birch, aspen, and the like. "Long" papermaking fibers are those papermaking fibers having an average length greater than about 1 millimeter, which includes the softwood species such as northern and southern pine. It is preferred that the first papermaking furnish comprise at least 75 weight percent short fibers and, more specifically, substantially all short fibers. Similarly, it is preferred that the second papermaking furnish comprise at least 75 weight percent long fibers and, more specifically, substantially all long fibers.

Suitable softening agents for treating the first (short) fiber furnish include a range of chemistries that contribute a soft, silky, smooth, velvety, fluffy, lotiony, cushiony, quilted, delicate, satiny, and soothing feel to the tissue. These agents include, but are not limited to: imidazoline quaternaries; ester quaternaries; phospholipids; silicone phospholipids; silicone quaternaries; quaternized lanolin derivatives; hydrolyzed wheat protein/polydimethyl siloxane; hydrolyzed wheat protein/dimethicone phosphocopolyol copolymer; organoreactive polysiloxanes; nonionic surfactants, such as alkylphenol ethoxylates, aliphatic alcohol ethoxylates, fatty acid alkoxylates, fatty alcohol alkoxylates, and block copolymers of ethylene oxide and propylene oxide; condensation products of ethylene oxide with the product resulting from the reaction of propylene oxide and ethylenediamine; condensation products of propylene oxide with the product of the reaction of ethylene oxide and ethylenediamine; semipolar nonionic surfactants, such as water soluble amine oxides; alkylpolysaccharides, such as alkylpolyglycosides; fatty acid amide surfactants; polyhydroxy compounds, including glycerol, polyethylene glycols, and polypropylene glycols having a weight average molecular weight from 200 to 4000; quaternized protein compounds; silicone emulsions and silicone glycols.

The amount of softening agent added to the first furnish can be any amount that is effective in increasing the softness of the resulting tissue and will depend on the particular softening agent selected and the desired softness effect. Nevertheless, suitable amounts of softening agent, based on the dry weight of fiber, can be about 0.005 weight percent or greater, more specifically from about 0.1 to about 1.0 weight percent, and still more specifically from about 0.3 to about 0.7 weight percent.

Dry strength agents that can be used include, without limitation, any type of starch, starch derivatives, gums, polyacrylamide resins, and carboxymethyl celluloses.

The amount of dry strength agent added to the blended furnish can be any amount that is effective in increasing the dry strength of the resulting tissue and will depend on the particular dry strength agent selected and the desired strength effect. Nevertheless, suitable amounts of dry strength agent can be, based on the dry weight of fiber, about 0.05 weight percent or greater, more specifically from about 0.1 to about 1.0 weight percent, and still more specifically from about 0.3 to about 0.5 weight percent.

Suitable wet strength agents include both permanent and temporary wet strength additives. Such wet strength agents include, without limitation, polyamine amide epichlorohydrin, urea-formaldehyde resins, melamine-formaldehyde resins, glyoxalated polyacrylamide resins, polyethyleneimene resins, dialdehyde starch, cationic aldehyde starch, cellulose xanthate, synthetic latexes, glyoxal, acrylic emulsions, and amphoteric starch siloxanes.

The amount of wet strength agent added to the blended furnish can be any amount that is effective in increasing the wet integrity of the resulting tissue and will depend on the particular wet strength agent selected and the desired strength effect. Nevertheless, suitable amounts of wet strength agent, based on the dry weight of fiber, can be about 0.05 weight percent or greater, more specifically from about 0.1 to about 3.0 weight percent, and still more specifically from about 0.3 to about 1.0 weight percent.

DETAILED DESCRIPTION OF THE DRAWINGS

Figure 1:
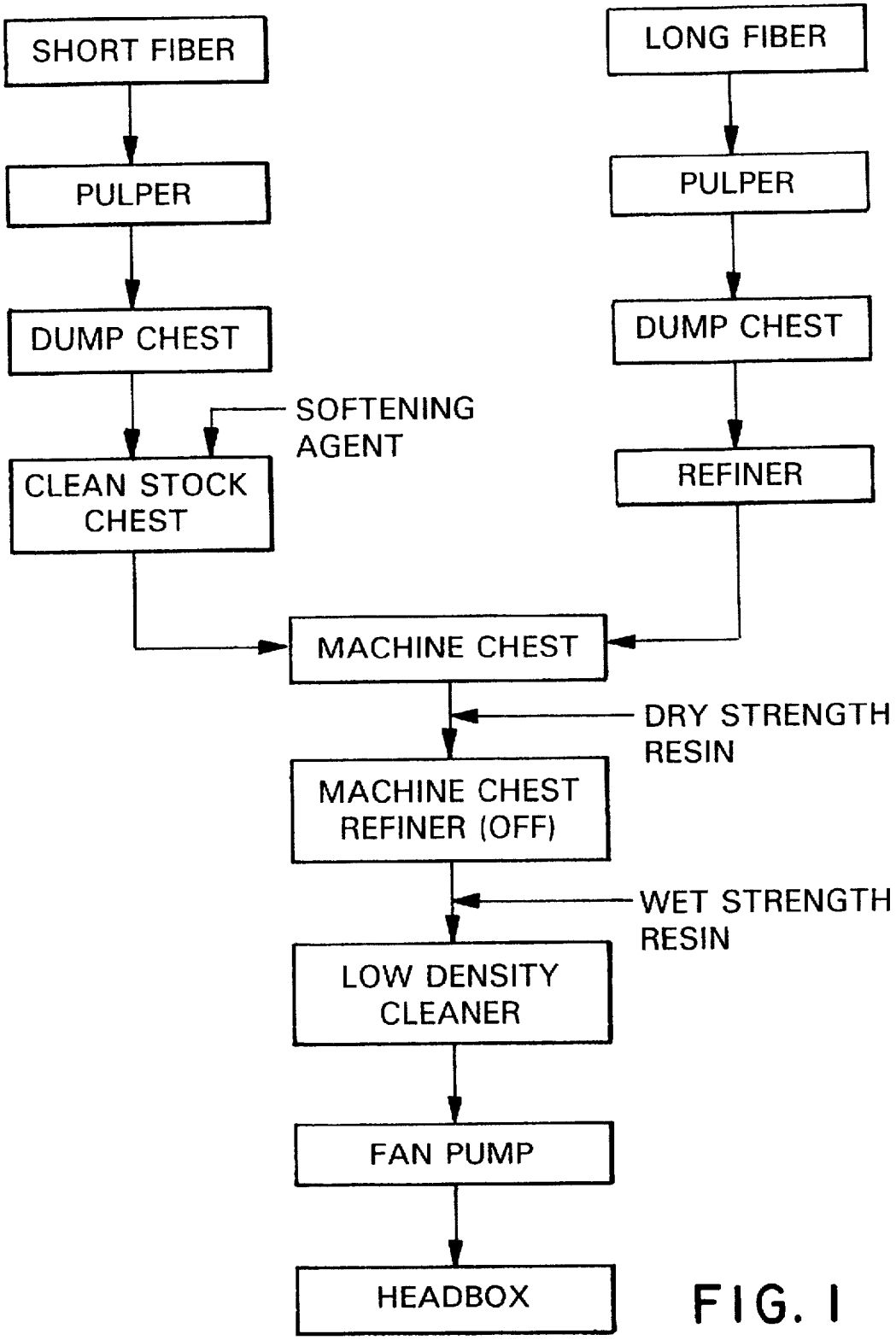
FIG. 1 is a schematic flow diagram of a stock prep system useful for the purposes of this invention.

FIG. 1 is a schematic flow diagram of a stock prep system useful in the practice of this invention. Shown are a first furnish of short fibers and a second furnish of long fibers being fed to low consistency hydrapulpers which disperse dry lap pulp and broke into individual fibers. Pulping typically occurs between 4–5% consistency. Both pulpers run continuously in a batch format to supply long and short fiber to the tissue machine. Once a batch of fiber is completed, it is pumped to a dump chest and diluted to 3–4% consistency. The short fiber furnish is not refined and is transferred directly to a clean stock chest and diluted to a consistency of about 2–3%. The clean stock chest is maintained at a constant level allowing continuous feed of a softening agent as shown to enhance the tactile properties of the finished product. The long fiber furnish, after being completely dispersed in the pulper, is pumped to a dump chest and diluted to 3–4% consistency. Thereafter the long fiber furnish is transferred to a refiner where a low level of refining (typically no-load) is applied to the long fiber to impart some sheet strength without deteriorating bulk and stiffening the tissue.

Both the short fiber and the long fiber furnishes are blended in the machine chest in a pre-determined short fiber/long fiber ratio, typically about 60% short fiber and about 40% long fiber. The consistency in the machine chest is about 2–3%. Machine broke can also be metered into the machine chest as well. The proportion of broke is dictated by performance specifications and current broke storage levels.

Once the two fiber furnishes are blended, the stock is pumped from the machine chest to a low density cleaner which decreases the stock consistency to 0.6%. At any convenient point after the two furnishes have been blended, such as between the machine chest and the low density cleaner, the dry and wet strength agents can be added sequentially to improve the sheet integrity. The sequence of addition will often depend on the polymeric charge densities of each material. If the charge densities are significantly different, it is preferable to first add the material having the lower charge density.

The blended stock is further diluted to about 0.1% at the fan pump prior to entering the headbox.

Figure 2:
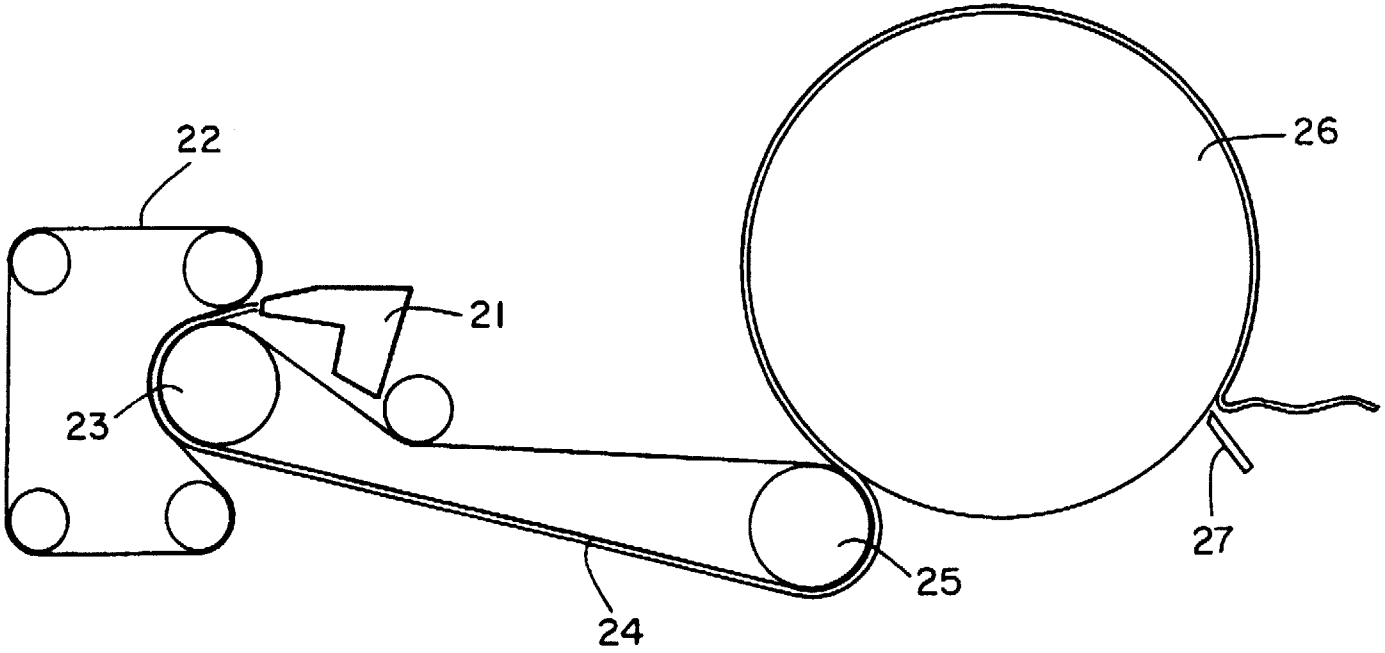
FIG. 2 is a schematic diagram of a tissue making process useful for carrying out the method of this invention.

FIG. 2 is a schematic flow diagram of a conventional wet-press tissue making process useful in the practice of this invention, although other tissue making processes can also benefit from the stock prep method of this invention, such as throughdrying or other non-compressive tissue making processes. The specific formation mode illustrated in FIG. 2 is commonly referred to as a crescent former, although many other formers well known in the papermaking art can also be used. Shown is a headbox 21, a forming fabric 22, a forming roll 23, a paper making felt 24, a press roll 25, a yankee dryer 26, and a creping blade 27. Also shown, but not numbered, are various idler or tension rolls used for defining the fabric runs in the schematic diagram, which may differ in practice. As shown, the headbox 21 continuously deposits a blended stock jet between the forming fabric 22 and felt 24, which is partially wrapped around the forming roll 23. Water is removed from the aqueous stock suspension through the forming fabric by centrifugal force as the newly-formed web traverses the arc of the forming roll. As the forming fabric and felt separate, the wet web stays with the felt and is transported to the yankee dryer 26.

At the yankee dryer, the creping chemicals are continuously applied on top of the adhesive remaining after creping in the form of an aqueous solution. The solution is applied by any conventional means, preferably using a spray boom which evenly sprays the surface of the dryer with the creping adhesive solution. The point of application on the surface of the dryer is immediately following the creping doctor 27, permitting sufficient time for the spreading and drying of the film of fresh adhesive.

The wet web is applied to the surface of the dryer by means of a pressing roll with an application force typically of about 200 pounds per square inch (psi). The incoming web is nominally at about 10% consistency (range from about 8 to 20%) at the time it reaches the pressure roll. Following the pressing and dewatering step, the consistency of the web is at or above about 30%. Sufficient yankee dryer steam power and hood drying capability are applied to this web to reach a final moisture content of about 2.5% or less.

EXAMPLES

Example 1

A soft, absorbent bath tissue product was made in accordance with this invention using the overall process of FIG. 2. More specifically, a first papermaking furnish consisting of eucalyptus hardwood fiber (short fibers) was treated with an imidazoline softening agent (methyl-1-oleyl amidoethyl-2-olyel imidazolinium methylsulfate, identified as C-6027, commercially available from Witco Corporation). The softening agent was added in the form of an aqueous mixture having approximately 1 percent solids. The addition rate was 0.11 weight percent based on dry fiber in the final tissue. At the point of addition, the eucalyptus thick stock was at about 2.5 percent solids. In the machine chest, a second papermaking furnish consisting of northern softwood kraft fiber was blended together with the treated first furnish at the same consistency. The resulting blended furnish contained about 60 dry weight percent eucalyptus fibers and about 40 dry weight percent northern softwood kraft fibers.

After the two furnishes were blended together, an amphoteric starch dry strength agent (Redi-Bond 2038, commercially available from National Starch and Chemical Company) and a glyoxalated polyacrylamide temporary wet strength agent (Parez 631-NC, commercially available from Cytec Industries, Inc.) were sequentially added to the blended furnish. The Parez 631-NC was added as a 6 percent aqueous mixture. The addition rate was 0.16 weight percent based on dry fiber. The Redi-Bond 2038 was added as a 1 percent mixture with water and the addition rate was 0.16 weight percent based on dry fiber. The resulting furnish was diluted to a consistency of about 0.6 dry weight percent.

The blended furnish was then further diluted to about 0.1 weight percent based on dry fiber, fed to a headbox and deposited from the headbox onto a multi-layer polyester forming fabric to form the tissue web. The web was then transferred from the forming fabric to a conventional wet-pressed carrier felt. The water content of the sheet on the felt just prior to transfer to the Yankee dryer was about 88 percent. The sheet was transferred to the Yankee dryer with a vacuum pressure roll. Nip pressure was about 230 pounds per square inch. Sheet moisture after the pressure roll was about 45 percent. The adhesive mixture sprayed onto the Yankee surface just before the pressure roll consisted of 40% polyvinyl alcohol, 40 percent polyamide resin and 20 percent quaternized polyamido amine. The spray application rate was about 5.5 pounds of dry adhesive per ton of dry fiber. A natural gas heated hood partially around the Yankee had a supply air temperature of 533 degrees Fahrenheit to assist in drying. Sheet moisture after the creping blade was about 1.5 percent. Machine speed of the 200 inch wide sheet was 4500 feet per minute. The crepe ratio was 1.27, or 27 percent. The resulting tissue was plied together and lightly calendered with two steel rolls at 10 pounds per lineal inch. The two-ply product had the dryer side plied to the outside. When converted, the finished basis weight of the two-ply bath tissue at TAPPI standard temperature and humidity was 22.0 pounds per 2880 square feet.

We claim:

1. A method of treating a papermaking furnish for making soft tissue comprising:

(a) adding about 0.005 weight percent or greater of a softening agent to a first papermaking furnish comprising primarily hardwood pulp fibers having an average length of about 1 millimeter or less; (b) blending the first papermaking furnish with a second papermaking furnish comprising primarily softwood papermaking fibers having an average length greater than about 1 millimeter; and (c) adding to the blended furnish one or more strengthening agents selected from the group consisting of dry strength agents in an amount of about 0.05 weight percent or greater and wet strength agents in an amount of about 0.05 weight percent or greater.

2. The method of claim 1 wherein the softening agent is an imidazoline quaternary compound.

3. The method of claim 1 wherein the first papermaking furnish consists essentially of hardwood papermaking fibers.

4. The method of claim 1 wherein the second papermaking furnish consists essentially of softwood fibers.

5. The method of claim 1 wherein a dry strength agent and a wet strength agent are sequentially added to the blended furnish.

6. The method of claim 5 wherein the strength agent having the lower charge density is added to the blended first.

7. The method of claim 6 wherein the dry strength agent is added to the blended furnish before the wet strength agent is added to the blended furnish.

8. The method of claim 7 wherein the dry strength agent is an amphoteric starch.

9. The method of claim 8 wherein the wet strength agent is a glyoxalated polyacrylamide.

* * * * *